United States Patent [19]

Fleissner

[11] 3,958,925

[45] May 25, 1976

[54] PROCESS AND APPARATUS FOR THE PRODUCTION OF BLENDS

[75] Inventor: Hans Fleissner, Riehen, Basel, Switzerland

[73] Assignee: Vepa AG, Switzerland

[22] Filed: Feb. 8, 1974

[21] Appl. No.: 440,758

[30] Foreign Application Priority Data

Feb. 8, 1973 Germany ..... 2306204

[52] U.S. Cl. ..... 8/14; 68/5 D; 8/62; 8/149

[51] Int. Cl.[2] ..... D06P 3/00; D06P 3/82

[58] Field of Search ..... 8/14, 62, 149; 68/5 D

[56] References Cited

UNITED STATES PATENTS 3,788,106 1/1974 True ..... 68/5 D 3,803,880 4/1974 Laing et al. ..... 68/5 D

*Primary Examiner*—M. J. Welsh

*Attorney, Agent, or Firm*—Craig & Antonelli

[57] ABSTRACT

A continuous process for the production of blends of fibers having two or more different colors which comprises passing a plurality of fiber slivers or strands of desired length together in mutually parallel relationship through at least one pair of printing rolls, and imprinting the fiber slivers or strands in one operating stage with different colorants in varying thicknesses and amounts, based on a unit length or unit area of said fiber slivers or strands.

10 Claims, 2 Drawing Figures

PROCESS AND APPARATUS FOR THE PRODUCTION OF BLENDS

Figure 1A:
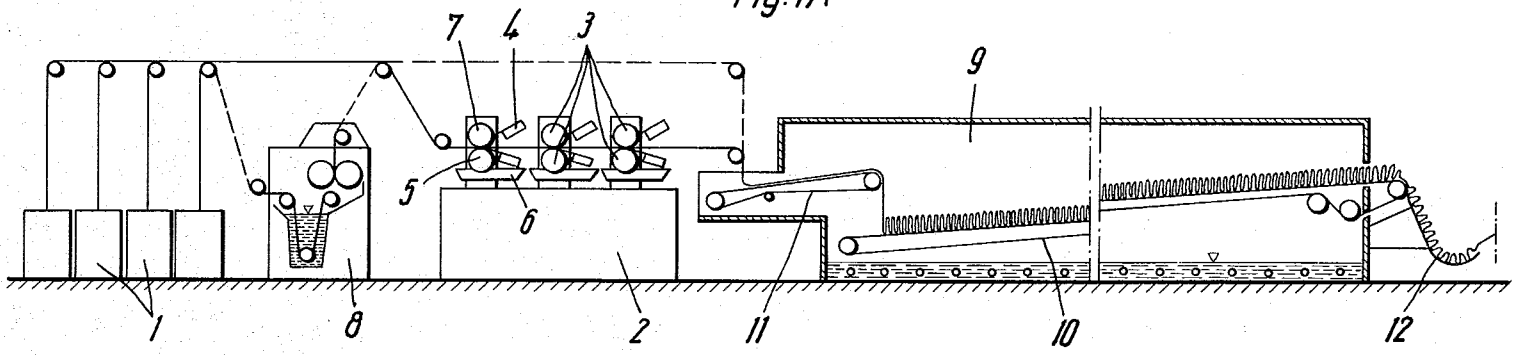

This invention relates to a process and apparatus for the production of fibrous blends consisting of fiber batches that have two or more different colors and that are made by the Vigoureux dyeing method and/or by solid-color dyeing.

Blends are composed of fiber slivers, such as combed sliver consisting of wool or cotton, or of fiber strands of synthetic fibers, e.g. polyester or polyacrylonitrile, in varying colors and with specific color patterns. The fiber batches necessary to obtain a desired combination have heretofore been produced by a discontinuous process. This holds true for the batches of solid-dyed slivers, and particularly for the batches made by the Vigoureux printing method for which special machines have been developed. It will be understood that in the Vigoureux printing method slivers, particularly wool slivers, are printed to provide a mixed color effect therein.

For this purpose, the combed slivers to be imprinted first pass, coming from a reel-off frame, through a printing machine wherein the slivers are initially made into a thin fibrous fleece by means of a simple needle field. This fleece then passes through a printing roller system, after which it is seized and gathered by a sliver depositing device and is then laid into baskets or the like. The printing machine consists of a dipping roller which transfers ink to a felt-covered delivery roller. The actual printing rolls rest, under load, on the delivery roller and press, in accordance with their profiles, the passing fleece against the delivery roll, thus wetting the fleece with ink along a larger or smaller area transversely across the operating width.

The dye deposited or printed sliver enters a steaming device in order to fix the dye, wherein the steaming process takes 1 to 3 hours, depending on the type of dye employed.

After cooling, the slivers pass through a dye back washer in order to free the slivers of excess dyes and chemicals. Subsequently, the slivers must be dried.

In this way, several colors and patterns are applied to the slivers, either on identical machines, simultaneously, or in sequence in one machine. For the production of the respective blend or combination, individual patterns and dyed slivers are then selected by hand from various batches and introduced into a blending machine for mixing and drawing. Only in this last-mentioned machine is the desired coloring effect attained.

The conventional manner of producing blends is very time consuming and requires a large number of man hours with concomitant expenses for wages. The invention is based on the problem of developing a process and apparatus which makes it possible to continuously produce in a single operating step any desired blend composed of solid-color fibrous components or mixtures thereof and/or of the Vigoureux fibrous components, so that the customary mixing processes prior to the drawing step, are eliminated. The drawing step is still necessary.

This problem is solved, in accordance with the present invention, by providing that in a continuous operating process, any desired length and an arbitrary number of fiber slivers or continuous strands of wool, synthetic fibers, such as polyesters or polyacrylonitrile or the like, pass together, in mutually parallel relationship, through at least one pair of printing rollers, thus, being printed in one operating step with different colorants, i.e., dyes or color pastes in varying thicknesses and amounts, based on a unit length or unit area. The dyes or pastes can be of any desired character. Thus, the colorants can also consist of a mixture containing heavy metal salts or optical brighteners, or also resist agents, so that any desired subsequent effect can be printed on the slivers or strands.

The printing pattern can advantageously be applied at least on a portion of the strands traveling together through the apparatus in the transverse direction with a certain color pattern and then, by means of a further printing means, with another color and another pattern. However, it is also possible to imprint one portion of the parallel-traveling fiber slivers only in the longitudinal direction with a color pattern and another portion disposed beside the one portion with another pattern. Of course, individual slivers can also be dyed in a solid color and can then be further treated together with the imprinted slivers. In any event, by means of these many variations in one operating step, effective fibrous blends can be produced, without having to combine individual prefabricated batches into a blend. By the structure of the printing unit, a desired blend can be predetermined for one machine run, which blend is then finally formed, after the customary, but presently continuously conducted treatment steps, with the aid of a conventional drawing device.

The known Vigoureux printing machine is not very well suitable for the heretofore described process. The forced contact of the necessarily thin fibrous fleece against the dye-impregnated felt bottom roll also has the disadvantage that the thus-obtained prints have differing color depths with an increasing operating time, due to changes in the properties of the felt roll. Also, the production of the thin fleeces for an entire blend batch is too complicated. It is more advantageous for the process of this invention if the material to be imprinted — independently of the time period for which the roll operates or the running length of the machine — is always provided with a constant amount of dye which also satisfactorily imprints combed sliver or synthetic fiber slivers. This is made possible, in a further development of the process of this invention by transferring to the slivers or the like, preferably on both sides, an always constant amount of ink or paste from indentations in at least one intaglio cylinder.

For the further treatment of the thus-imprinted slivers, conventional machine components known per se for the continuous treatment of fibrous material can be utilized. The process conducted thereby resides in that the parallel-traveling, imprinted or solid-dyed fibrous slivers or strands are conducted together into a fixing unit, such as a belt steamer, in a continuous procedure which follows immediately, in order to fix the thus-applied dye. The fibrous material to be treated, in this step, passes through the hot atmosphere preferably as a denser layer. Thereafter, the material travels through a washing device, preferably a sieve drum washing device with several washing baths, and finally is dried, preferably also in a sieve drum dryer, prior to being delivered from the apparatus. It is also possible, before the strands or slivers are deposited after exiting from the apparatus, to feed these strands directly to a mixing zone which draws from one blend batch one or also several slivers with the desired color effect.

Figure 1B:
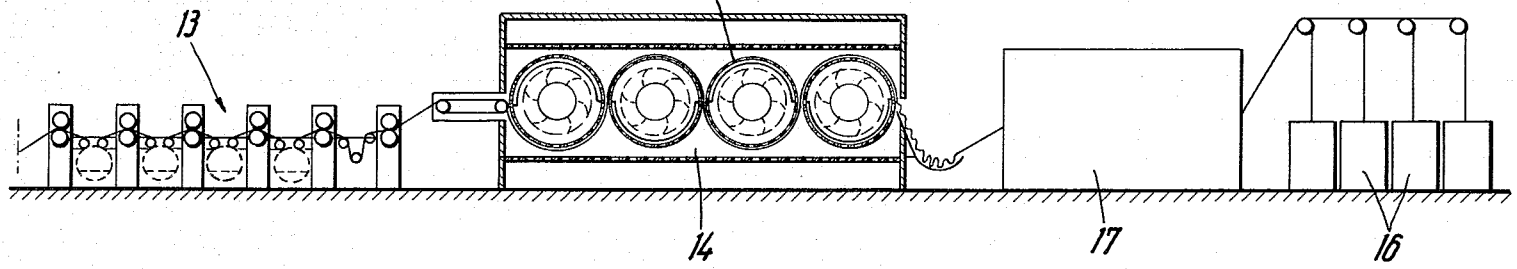

The process and apparatus of this invention will be further understood from the following detailed description and the accompanying drawing, wherein FIGS. 1A and 1B show the apparatus.

The fiber strands or the like necessary for producing a blend batch are withdrawn from the cans or containers 1 and together are fed in parallel relationship to a printing and/or dyeing system, connected thereafter. This system consists essentially of the Vigoureux printing machine 2 which, according to the drawing, is equipped with three pairs of printing rolls 3. The individual rolls of the printing roll pairs 3 are made of steel and have a polished surface. Patterns are engraved in this surface in a conventional manner, and these patterns are filled with inks or pastes with the aid of scrapers 4. In the present embodiment, the lower roll 5 of each pair of rollers automatically absorbs the ink from a trough 6. The scraper 4 associated with this roll smooths out the ink received within the engravings. In the upper roll 7, the dye is fed into a slot between the roll and the scraper. In this way, the top roll as well as the bottom roll of a printing roll pair 3 can imprint on the passing fibrous material a different pattern with the respectively desired color; in each individual case — independently of the operating length of the printing unit — a constant amount of ink is always offered to the material and absorbed thereby.

In front of the Vigoureux printing machine 2, a padder or dyeing unit 8 is arranged, with the aid of which individual fiber slivers or strands can also be dyed with a solid color. The path of these slivers is shown in dashed lines. After the dyeing step, these slivers travel above the printing machine 2, so that the printing rolls are not unnecessarily stressed and contaminated.

Following the printing and/or dyeing unit 2, 8, there is a sieve belt steamer 9. An endless belt 10 which extends through the steamer, rotates more slowly than the delivery speed of the fibrous material. By means of the feed belt 11 extending into the steamer, the dyed and/or printed material is deposited in compact folds or layers onto the endless belt 10. After the steaming step, the slivers or strands slide into an equalizing trough 12 from where they are withdrawn by the sieve drum washing machine 13. In this washing machine, the number of slivers is continuously cleansed of excess dyes and chemicals. The subsequent sieve drum dryer 14, having several sieve drums 15 under a suction draft, dries the material and transports it immediately in the direction toward a depositing means 16 or, previously, to a mixing gill box machine or mixing zone not illustrated in detail and denoted by reference numeral 17.

It will be understood that this mixing zone consists of several intersecting heads; the strands exiting therefrom are combined, laterally withdrawn and then drawn as a wide band from a collective drawing unit. The process takes place before processing in the initial spinning device when several differently colored combed slivers are to be mixed in order to obtain a desired colored hue.

The above-described plant produces automatically, without a large number of operating personnel, any desired batch for a blend. For this purpose, at the beginning of the production line, the number of slivers to be imprinted or to be dyed and also the printing pattern with the respective ink are determined. After passing through the system, the bundle of continuous strands can immediately be fed to the drawing unit, so that, in addition to obtaining the advantages of a continuous plant, the present invention also saves the space and the machine unit for the customary mixing processes.

While the novel embodiment of the present invention has been described, it will be understood that various omissions, modifications and changes in this embodiment may be made by one skilled in the art without departing from the spirit and scope of the invention.

What is claimed is:

1. A process for the production of blends of fibers having two or more different colors which comprises, in a continuous operating procedure, passing a plurality of fiber slivers or strands of desired lengths together in mutually parallel relationship through at least one pair of printing rolls, and imprinting the fiber slivers or strands together in one operating stage with different colorants in varying thicknesses and amounts, based on a unit length or unit area of said fiber slivers or strands whereby a desired mixed color effect is obtained in said fibers.

2. The process of claim 1, in which at least one portion of the number of strands is printed only in the longitudinal direction with the color pattern, and another portion disposed beside the one portion is imprinted in the longitudinal direction with a different color pattern.

3. The process of claim 1, in which at least a portion of the number of strands is imprinted in the transverse direction with a color pattern and subsequently with another color pattern.

4. The process of claim 1, in which a portion of the parallel-traveling fiber slivers or strands is dyed in a solid color.

5. The process of claim 1, in which a portion of the parallel-travelling fiber slivers is dyed in mixed colors.

6. The process of claim 1, in which, for production of printing patterns on the fiber slivers or strands that travel through a pair of printing rolls, an always constant amount of colorant is transferred to both sides of the slivers from indentations in at least one intaglio or engraved roller.

7. The process of claim 1, in which the colored parallel-travelling fiber slivers or strands are conducted together, in a directly following continuous stage, for the fixation of the thus-applied colors, into a fixing unit, wherein the material passes preferably in dense folds or layers through a hot atmosphere, the material then passes through a washing unit, and finally, prior to being deposited, the material is dried in a drying device.

8. The process of claim 1, in which the fixing unit is a belt steamer, the washing unit is a sieve drum washing device with several washing baths, and the drying device is a sieve drum drier.

9. The process of claim 7, in which the number of imprinted and/or solid-color-dyed fiber slivers or strands is together fed to a mixing zone immediately after drying in said drying device.

10. The process of claim 1, further comprising fixing the colorants to said fiber slivers or strands in a heated atmosphere, washing the thus-fixed fiber slivers or strands, drying the fiber slivers or strands and thereafter drawing the fiber slivers or strands.

* * * * *